US009478926B2

(12) United States Patent
Le Cozic et al.

(10) Patent No.: US 9,478,926 B2
(45) Date of Patent: Oct. 25, 2016

(54) MULTI-ACCESS RJ45 ADAPTOR

(75) Inventors: Hervé Le Cozic, Lannion (FR); Pierrick Guillas, Pleumeur Bodou (FR); Olivier Bouffant, Pleumeur Bodou (FR)

(73) Assignee: FRANCE TELECOM, Paris (FR)

( * ) Notice: Subject to any disclaimer, the term of this patent is extended or adjusted under 35 U.S.C. 154(b) by 233 days.

(21) Appl. No.: 13/989,001

(22) PCT Filed: Nov. 14, 2011

(86) PCT No.: PCT/FR2011/052636

§ 371 (c)(1),
(2), (4) Date: Aug. 5, 2013

(87) PCT Pub. No.: WO2012/069731

PCT Pub. Date: May 31, 2012

(65) Prior Publication Data

US 2013/0309914 A1 Nov. 21, 2013

(30) Foreign Application Priority Data

Nov. 26, 2010 (FR) ..... 10 59779

(51) Int. Cl.
*H01R 24/00* (2011.01)
*H01R 24/64* (2011.01)
*H01R 31/00* (2006.01)

(52) U.S. Cl.
CPC ..... *H01R 24/64* (2013.01); *H01R 31/005* (2013.01); *H01R 2201/04* (2013.01); *H01R 2201/16* (2013.01)

(58) Field of Classification Search
CPC .. H01R 13/64; H01R 13/639; H01R 13/625; H01R 27/02; H01R 9/0506; H01R 23/02; H01R 24/60; H01R 24/62
USPC ..... 439/660, 639, 135, 139, 140, 136, 137, 439/138, 145
See application file for complete search history.

(56) References Cited

U.S. PATENT DOCUMENTS 5,017,147 A * 5/1991 Sugiyama et al. ..... 439/144
5,217,395 A * 6/1993 Bailey ..... H01R 29/00 439/620.21

(Continued)

FOREIGN PATENT DOCUMENTS

EP 1378970 A1 1/2004
FR 2908932 A1 5/2008

(Continued)

OTHER PUBLICATIONS

International Search Report and Written Opinion dated Jun. 28, 2012 for corresponding International Application No. PCT/FR2011/052636, filed Nov. 14, 2011.
French Search Report and Written Opinion dated Aug. 3, 2011 for corresponding French Application No. FR 1059779, filed Nov. 26, 2010.

(Continued)

*Primary Examiner* — Abdullah Riyami
*Assistant Examiner* — Thang Nguyen
(74) *Attorney, Agent, or Firm* — David D. Brush; Westman, Champlin & Koehler, P.A.

(57) ABSTRACT

A multi-access RJ45 adaptor is provided, which includes an RJ45 plug, at least two RJ45 sockets, and a mobile piece that can move between the at least two RJ45 sockets. The mobile piece is configured to allow insertion of an RJ45 plug into any of the RJ45 sockets and simultaneously to prevent the insertion of another RJ45 plug into the other of the RJ45 sockets.

6 Claims, 2 Drawing Sheets

(56) References Cited

U.S. PATENT DOCUMENTS

| | | | | |
|---|---|---|---|---|
| 7,048,550 | B2 * | 5/2006 | Hyland | H01R 31/005 439/540.1 |
| 7,819,703 | B1 * | 10/2010 | Walker | H01R 13/6658 439/540.1 |
| 2002/0001998 | A1 * | 1/2002 | Lo | 439/502 |
| 2002/0146113 | A1 * | 10/2002 | Chu | H01R 27/02 379/399.01 |
| 2004/0005804 | A1 * | 1/2004 | Kubota et al. | 439/347 |

FOREIGN PATENT DOCUMENTS

| | | | |
|---|---|---|---|
| GB | 2402269 | A * | 12/2004 |
| WO | 2008062123 | A1 | 5/2008 |

OTHER PUBLICATIONS

International Preliminary Report on the Patentability and Written Opinion dated May 28, 2013 for corresponding International Patent Application No. PCT/EP2011/052636, filed Nov. 14, 2011.

* cited by examiner

MULTI-ACCESS RJ45 ADAPTOR

CROSS-REFERENCE TO RELATED APPLICATIONS

This Application is a Section 371 National Stage Application of International Application No. PCT/FR2011/052636, filed Nov. 14, 2011, which is incorporated by reference in its entirety and published as WO 2012/069731 on May 31, 2012, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The field of the invention is that of connectors and more particularly of RJ45 type connectors ("RJ" meaning "Registered Jack").

This type of connector is widely used, in particular as a network card connector for Ethernet networks, or in domestic telephony installations where it replaces F-010 connectors.

BACKGROUND OF THE DISCLOSURE

An RJ45 connector includes eight electrical connection pins and a domestic installation is in general wired using cable having four pairs of wires, each wire being connected to a respective pin of the RJ45 connector.

An RJ45 socket thus connected is considered. The four pairs enable access to several services on this same RJ45 socket. These services are:

an analog telephone service, an IP (Internet Protocol) telephone service, two Ethernet accesses.

Adaptors have therefore been proposed to allow access to two services simultaneously from a single RJ45 socket. These adaptors include an RJ45 plug that can be connected to the RJ45 socket, and two RJ45 sockets. The internal wiring of the adaptors depends on the services to which they provide access.

It is to be noted that the analog and IP telephone services each use one pair of wires and that the Ethernet accesses each use two pairs of wires.

It is understood that to simultaneously use two different services, they must use different pairs, otherwise malfunctions would occur.

Thus, a first type of adaptor provides for the simultaneous use of an analog and an IP telephone service, using the third and fourth pairs.

A second type of adaptor provides for the simultaneous use of an analog telephone service and an Ethernet access using the first, second and third pairs.

A third type of adaptor provides for the simultaneous use of an IP telephone service and an Ethernet access using the first, second and fourth pairs.

A fourth type of adaptor provides for the simultaneous use of two Ethernet accesses using the four pairs.

These adaptors are designed and wired to provide for only connections or combinations of connections which function, according to the pairs used by each service. However, the user must use a different adaptor for each combination of services used simultaneously.

SUMMARY

An exemplary embodiment of the invention proposes a multi-access RJ45 adaptor including one RJ45 plug and at least two RJ45 sockets, characterized in that it includes a piece movable between said at least two RJ45 sockets, the movable piece being intended to allow the insertion of an RJ45 plug into any one of the RJ45 sockets and simultaneously prevent the insertion of another RJ45 plug into the other of the RJ45 sockets.

By virtue of an embodiment of the invention, it is possible to connect two RJ45 sockets of the adaptor to a same pin of the RJ45 plug of the adaptor, this connection corresponding to two different services, while preventing a simultaneous connection of these two sockets, and consequently a simultaneous use of these two services, which would cause malfunctions.

According to a particular feature, the two RJ45 sockets are arranged substantially on the same axis and in opposite directions.

This arrangement facilitates the operation of the adaptor.

According to a particular feature, the movable piece is intended to be moved between the RJ45 sockets such that the insertion of an RJ45 plug into any one of the RJ45 sockets pushes the movable piece until a part of the movable piece enters the housing of the other RJ45 socket.

This implementation of the invention is for a reliable use for the user. The displacement of the movable piece can be a translation or a rotation.

According to a particular feature, the adaptor includes four RJ45 sockets and the movable piece is intended to be moved between two extreme positions corresponding to the possible simultaneous insertion of RJ45 plugs into a first subset of three RJ45 sockets or into a second subset of two RJ45 sockets.

This configuration is suitable for the use of the eight pins of the RJ45 plug of the adaptor in order to propose four services via the four RJ45 sockets, at least one same pin of the RJ45 plug of the adaptor being used by at least two services.

According to a particular feature, the first subset of RJ45 sockets corresponds to an analog telephone service, an IP telephone service and a first Ethernet access and the second subset of RJ45 sockets corresponds to the first and a second Ethernet access.

BRIEF DESCRIPTION OF THE DRAWINGS

Other features and advantages will become clearer upon reading about an embodiment described with reference to the drawings in which.

DETAILED DESCRIPTION OF ILLUSTRATIVE EMBODIMENTS

Figure 1:
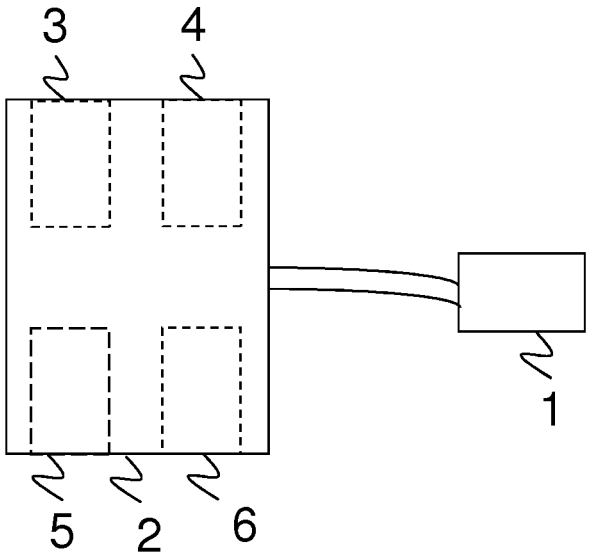
FIG. 1 represents an embodiment of a multi-access RJ45 adaptor according to the invention.

According to one embodiment of the invention represented in FIG. 1, an RJ45 adaptor includes an RJ45 plug 1 intended to be connected to an RJ45 socket, not represented, forming part of a telephony installation of the residential wiring as defined in the guide UTE C 90483. The RJ45 plug is conventional and includes eight electrical connection pins.

The adaptor also includes a substantially parallelepiped-shaped casing 2 in which four RJ45 sockets, labeled 3, 4, 5 and 6, are positioned. Only one face of the casing 2 is represented, and the sockets are shown schematically by rectangles in dotted-line. Each of these RJ45 sockets is connected electrically to the plug 1 so that each RJ45 socket provides for the use of one service. Each of these sockets is conventional per se and includes a housing open on one face of the casing 2 in order to provide for the insertion of an external RJ45 plug.

Figure 2:
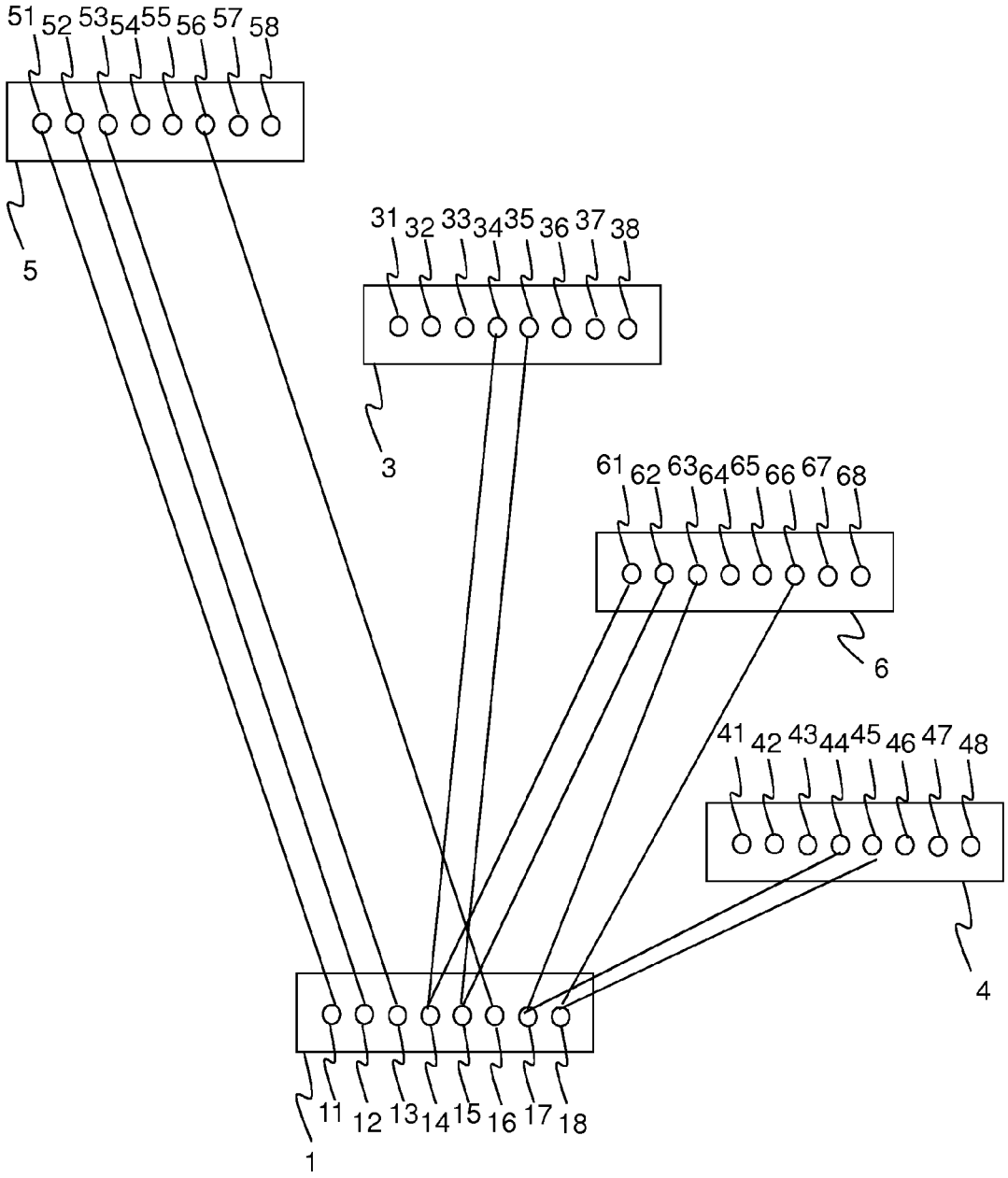
FIG. 2 represents an embodiment of the internal connections of the adaptor according to the invention.

FIG. 2 represents the internal connections of the adaptor according to the invention, between the plug 1 and the four sockets 3, 4, 5 and 6. The plug 1 includes eight pins labeled 11 to 18, the socket 3 includes eight pins labeled 31 to 38, the socket 4 eight pins labeled 41 to 48, the socket 5 eight pins labeled 51 to 58, and lastly the socket 6 eight pins labeled 61 to 68.

Thus, the first socket 3 is dedicated to an analog telephone service. This service requires the use of one pair. As represented in FIG. 2, the pins 14 and 15 of the plug 1 are connected to the pins 34 and 35 of the socket 3.

The second socket 4 is dedicated to an IP telephone service. This service also requires the use of one pair. The pins 17 and 18 of the plug 1 are connected to the pins 44 and 45 of the socket 4.

The third socket 5 is dedicated to a first Ethernet access. This service requires the use of two pairs. The pins 11, 12, 13 and 16 of the plug 1 are connected to the pins 51, 52, 53 and 56 of the socket 5.

The fourth socket 6 is dedicated to a second Ethernet access. This service requires the use of two pairs. The pins 14, 15, 17 and 18 of the plug 1 are connected to the pins 61, 62, 63 and 66 of the socket 6.

It is understood that two services each use two pins of the plug 1 and that two services each use four pins of the plug 1, which includes in total eight pins.

As already mentioned, it is not possible to use a same pin for two services simultaneously.

Thus, it is not possible to simultaneously use the four services. It is possible to simultaneously use, alternately:

the analog telephone service, the IP telephone service and the first Ethernet access, or any subset of these services, the two Ethernet accesses, or any subset of these services.

The RJ45 sockets 3 and 4 corresponding to the analog and IP telephone services are side by side. Likewise, the RJ45 sockets 5 and 6 corresponding to the first and second Ethernet accesses are side by side. These two groups of sockets are in opposite directions, such that their openings are on opposite faces of the casing 2. The socket 4 corresponding to the IP telephone service is substantially on the same axis as the socket 6 corresponding to the second Ethernet access, and in an opposite direction to the latter. As a variant, it is the socket 3 corresponding to the analog telephone service which is substantially on the same axis as the socket 6 corresponding to the second Ethernet access, and in an opposite direction to the latter.

Figure 3:
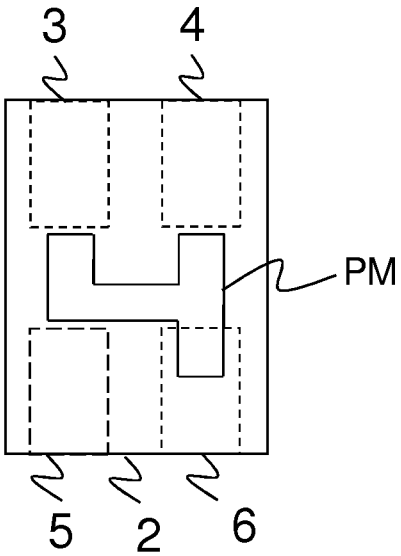
FIG. 3 represents an embodiment of the casing included in the adaptor according to the invention, in a first configuration.
Figure 4:
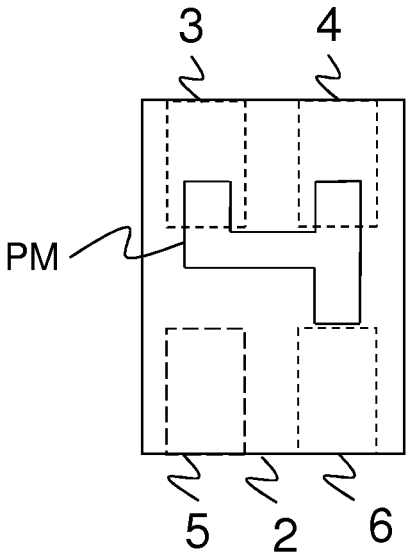
FIG. 4 represents an embodiment of the casing included in the adaptor according to the invention, in a second configuration.

With reference to FIGS. 3 and 4, the casing 2 of the adaptor is represented in cross-section according to a plane passing through the four RJ45 sockets. The casing 2 includes a movable piece PM which moves in a housing between two extreme positions. The movable piece is a plate which includes three protruding parts respectively intended to be inserted into the housing of an RJ45 socket of the casing.

The movable piece is intended to be displaced by translation between its two extreme positions.

The first position is represented in FIG. 3. In this position, the movable piece has a protruding part in the housing of the RJ45 socket 6 corresponding to the second Ethernet access. The three other RJ45 sockets 3, 4 and 5 are free.

Thus, a user can insert an external RJ45 plug into one, two or three of the free sockets, corresponding to the analog telephone service, the IP telephone service and the first Ethernet access respectively.

From the moment when an RJ45 plug is inserted into one of these sockets, the movable piece is locked in the first extreme position and it becomes impossible to simultaneously insert a plug into the socket 6 corresponding to the second Ethernet access.

The second position is represented in FIG. 4. In this position, the movable piece has two protruding parts in the housings of the RJ45 sockets 3 and 4 corresponding to the analog and IP telephone services. The other two RJ45 sockets are free.

Thus, a user can insert an external RJ45 plug into one or two of the free sockets 5 and 6, corresponding to the first and second Ethernet accesses respectively.

From the moment when an RJ45 plug is inserted into the socket 6 corresponding to the second Ethernet access, the movable piece is locked in the second extreme position and it becomes impossible to simultaneously insert a plug into the sockets 3 and 4 corresponding to the analog and IP telephone services.

Of course, a person skilled in the art can envisage variants without departing from the scope of the invention. In particular, the movable piece can take different shapes. Depending on the respective positions of the RJ45 sockets relative to one another, the movement of the movable piece can be rotational instead of translational.

The invention claimed is:

1. A multi-access RJ45 adaptor comprising:

one RJ45 plug;

at least two RJ45 sockets; and a piece movable between said at least two RJ45 sockets, the movable piece being configured to allow insertion of an RJ45 plug into any one of the RJ45 sockets and simultaneously prevent insertion of another RJ45 plug into the other of the RJ45 sockets, wherein the movable piece is movable between the RJ45 sockets such that the insertion of an RJ45 plug into any one of the RJ45 sockets pushes the movable piece until a part of the movable piece enters a housing of the other RJ45 socket.

2. The adaptor as claimed in claim 1, wherein the two RJ45 sockets are arranged substantially on the same axis and in opposite directions.

3. The adaptor as claimed in claim 1, wherein the adapter includes four RJ45 sockets and the movable piece is movable between two extreme positions corresponding to the possible simultaneous insertion of RJ45 plugs into a first subset of three RJ45 sockets or into a second subset of two RJ45 sockets.

4. The adaptor as claimed in claim 3, wherein the first subset of RJ45 sockets corresponds to an analog telephone service, an IP telephone service and a first Ethernet access, and the second subset of RJ45 sockets corresponds to the first and a second Ethernet access.

5. A multi-access RJ45 adaptor comprising:

one RJ45 plug;

four RJ45 sockets; and a piece movable between said at least two RJ45 sockets, the movable piece being configured to allow insertion of an RJ45 plug into any one of the RJ45 sockets and simultaneously prevent insertion of another RJ45 plug into another of the RJ45 sockets, and the movable piece is movable between a first extreme position corresponding to a possible simultaneous insertion of RJ45 plugs into a first subset of three of the four RJ45 sockets and a second extreme position corresponding to a possible simultaneous insertion of RJ45 plugs into a second subset of two of the four RJ45 sockets.

6. The adaptor as claimed in claim 5, wherein the first subset of RJ45 sockets corresponds to an analog telephone service, an IP telephone service and a first Ethernet access, and the second subset of RJ45 sockets corresponds to the first and a second Ethernet access.

* * * * *